United States Patent [19]

Bhat

[11] Patent Number: 4,654,980

[45] Date of Patent: Apr. 7, 1987

[54] SOLVENT REMOVAL USING A CONDENSABLE HEAT TRANSFER VAPOR

[75] Inventor: Dinesh M. Bhat, Richmond, Va.

[73] Assignee: James Rivers Corporation, Richmond, Va.

[21] Appl. No.: 721,942

[22] Filed: Apr. 11, 1985

[51] Int. Cl.[4] ..... F26B 3/04

[52] U.S. Cl. ..... 34/12; 34/23; 34/36; 34/155; 34/228

[58] Field of Search ..... 34/9, 12, 23, 27, 29, 34/36, 155, 228

[56] References Cited

U.S. PATENT DOCUMENTS

| | | | |
|---|---|---|---|
| 1,261,005 | 4/1918 | Barstow et al. | 34/28 |
| 2,174,170 | 9/1939 | Schweizer | 34/23 |
| 2,255,859 | 9/1941 | Quigley | 34/155 |
| 2,298,803 | 10/1942 | Morris | 34/23 |
| 2,565,152 | 8/1951 | Wachter | 427/377 |
| 2,590,850 | 4/1952 | Dungler | 34/23 |
| 2,991,194 | 7/1961 | Cambron | 162/165 |
| 3,089,250 | 5/1963 | Victor | 34/37 |
| 3,991,481 | 11/1976 | Coraor et al. | 34/73 |
| 4,242,808 | 1/1981 | Luthi | 34/23 |
| 4,421,794 | 12/1983 | Kinsley | 34/23 |

*Primary Examiner*—Albert J. Makay
*Assistant Examiner*—David W. Westphal
*Attorney, Agent, or Firm*—Burns, Doane, Swecker & Mathis

[57] ABSTRACT

Non-aqueous solvents are removed from a web material, e.g., paper, by contacting the material with a condensable, heat transfer vapor, e.g. saturated steam, in countercurrent fashion. The heat transfer vapor is employed in the process in amounts of at least 50% by weight of the solvent to be removed. The process allows effective and efficient total removal and recovery of the solvent without damage to the web material. The condensable heat transfer vapor, as well as being the source of energy for evaporating the solvent, acts as a solvent vapor carrier. Condensation of the mixture in a recovery apparatus, e.g., condenser or still, allows easy recovery of the solvent.

28 Claims, 3 Drawing Figures

METHANOL - WATER
TEMPERATURE - COMPOSITION PHASE DIAGRAM

SOLVENT REMOVAL USING A CONDENSABLE HEAT TRANSFER VAPOR

BACKGROUND OF THE INVENTION

1. Field of the Invention

This invention relates to a novel process for removing a non-aqueous solvent from a web material such as paper, and optionally thereafter recovering the solvent. In another aspect, this invention relates to a process for removing a non-aqueous solvent from coated or impregnated paper using the latent heat from a condensable vapor. Preferably, the heat transfer vapor used in the solvent removal process is comprised of substantially saturated steam.

2. Description of the Prior Art

The quest for a more efficient and effective process for removing non-aqueous solvents, e.g., organic solvents, from a web material such as paper, cloth and non-woven or woven fabrics, has been continuous. This is particularly true for areas of technology employing commercial processes involving the impregnation of a web substrate with a resin wherein the resin is applied as a solution. The solution generally comprises a non-aqueous, organic solvent, removal and recovery of which is desirable for economic and environmental reasons.

The paper industry is one specific industry where the need for a more efficient and effective process for the removal of non-aqueous solvents is pronounced. More particularly, such need is especially pronounced in that portion of the paper industry pertaining to the impregnation of a paper substrate with phenol-formaldehyde resin. The phenol-formaldehyde resin is generally applied in an alcohol, e.g., methanol solution, with the methanol solvent being removed in a hot air oven. Compare U.S. Pat. No. 2,991,194 issued to Cambron, July 4, 1961.

The use of a hot air oven in the removal of such a solvent, however, has many disadvantages. For example, there is a danger of explosion due to the presence of oxygen. To reduce this danger, the volume of air that is heated and employed is generally verv large in order to provide sufficient dilution of the organic solvent to keep the concentration of the alcohol below the Lower Explosive Limit (LEL). The LEL is the concentration of the organic vapor below which, upon ignition, there is insufficient energy to propagate an explosion. Maintaining an air oven with sufficient dilution to stay below the LEL requires heating large quantities of air which is energy inefficient.

Other disadvantages lie in the cost and difficulty of recovering the solvent, e.g., alcohol solvent. Once the hot air has removed the solvent, the recovery of the alcohol from the hot air requires cooling the air and passing the cooled gas through a bed of activated charcoal on which the alcohol is adsorbed. The charcoal bed is then stripped of solvent by using steam, the steam-solvent vapor mixture is condensed, and finally, the steam-solvent mixture is distilled to recover water and solvent. However, because of the difficulties and expense involved in recovering the alcohol solvent by the foregoing, and other known methods of recovery, the alcohol vapors originating from the resin are generally exhausted to the atmosphere, or incinerated without recovery, in the hot air oven exhaust gas. Exhaustion to the atmosphere produces a severe environmental impact. Incineration is undesirable because it is expensive, capital intensive and can cause odor problems.

Other workers have employed steam as a heat source for evaporating organic solvents from various substrates. Note, for example, U.S. Pat. No. 1,261,005 issued to Barstow et al; U.S. Pat. No. 2,174,170 issued to Schweizer; U.S. Pat. No. 2,590,850 issued to Dungler; and, U.S. Pat. No. 3,089,250 issued to Victor.

U.S. Pat. No. 1,261,005 discloses the use of steam or some other vapor for the removal of volatile solvents from liquid or solid materials. In particular, the process is used in the extraction of oils from particulate solid material. The process disclosed passes the particulate material in a continuous current through a contacting chamber, with the steam or other vapor being passed countercurrently to the solid material. The usefulness of steam in the removal of solvents from a continuous web substrate such as paper is not discussed or considered in the patent.

U.S. Pat. No. 2,174,170 uses steam in a concurrent fashion, i.e., the steam being admitted at the point where the web enters the contacting chamber, vis-a-vis a countercurrent contact where the steam is admitted at the point where the web exits the chamber. Also, the resin system used in the patent is one which is very tolerable of water, e.g., the resin will not precipitate with water, and indeed, contains water.

Another patent, U.S. Pat. No. 2,565,152, issued to Wachter et al, discloses the use of steam in treating fibrous materials with phenolic resins. In the process disclosed, the resin solution is applied to the fibrous material and then steamed. The amount of steam used varies from 1% to 10% of the weight of the resin varnish. Improved impregnation of the resin varnish is the main objective and benefit of the steam procedure of Wachter et al. Drying and removal of the solvent is accomplished subsequently in a conventional hot air oven.

The use of saturated steam in the removal of non-aqueous solvents from many substrates has generally been avoided in the past due to several problems. One, the removal of all the solvent has been found to be very difficult and inefficient through the use of saturated steam. Generally, because of the process parameters used and design of the equipment, e.g., concurrent design. Two, the wetting of a substrate, particularly a web material such as paper, by the use of saturated steam is believed to be very harmful, because it was believed that moisture would precipitate a water sensitive resin, e.g., phenolformaldehyde, in the paper, which was thought to be detrimental to the physical properties of the product. Accordingly, the use of superheated steam was attempted.

U.S. Pat. No. 4,421,794, issued to Kinsley, Jr., discloses the removal of non-aqueous solvents from a substrate such as paper by contacting the substrate with a condensable heat transfer medium which is in a superheated state, e.g., superheated steam. The heat transfer medium is maintained in the superheated state throughout the contacting period so as to effect removal of the solvent without concomitant condensation of the medium onto the substrate. The process thereby avoids the problem of wetting a paper substrate, which the industry believes should be avoided otherwise severe damage to the paper substrate can be realized.

Note also U.S. Pat. No. 4,242,808, issued to Luthi, which discloses contacting a paper web directly with superheated steam to evaporate water from the paper web. The paper web drying system includes a direct contact dryer, a superheater such as a heat exchanger, means for feeding the exhaust steam from the direct contact dryer to the heat exchanger, and means for feeding superheated steam from the heat exchanger back to the direct contact dryer. The removal of a non-aqueous solvent is not discussed or disclosed.

Compare also U.S. Pat. No. 2,298,803, issued to Morris, which discloses the use of superheated steam to dry printed matter. The process involves subjecting the surface of the paper upon which the print has been applied to the action of superheated steam.

The problem of removing and recovering all of a solvent most effectively and efficiently from a web material such as paper, however, has heretofore been unsolved. The use of superheated steam can be most expensive because it requires the use of at least 3 lbs of superheated steam per lb. of solvent removed and it requires the use of a superheater. The use of saturated steam would be more economical in terms of steam use and energy.

Accordingly, it is a major object of this invention to provide a novel process devoid of the aforementioned disadvantages wherein steam is employed.

Another object of this invention is to provide a method for thermally treating a web material, such as paper, from which volatile substances of inflammable character are to be removed in such a manner that all danger of explosion is averted.

Yet another object of this invention is to provide a quick and efficient process for the removal and recovery of a solvent from a web material without exhausting organic substances to the atmosphere.

Another object of this invention is to treat an impregnated or coated web from which a non-aqueous volatile solvent is to be removed with a heat transfer vapor which also performs as a solvent vapor carrier.

Still another object of this invention is to provide an easy and efficient method for recovering the organic solvent from a water insoluble resin coated paper.

Other objects, features, and advantages of the present invention will become apparent to those skilled in the art upon a study of the disclosure, the appended claims and the drawing.

SUMMARY OF THE INVENTION

In accordance with the foregoing objectives, there is provided by the present invention a process for the removal of substantially all the non-aqueous solvent from a web material, e.g., paper. The process comprises contacting the web material with a condensable, heat transfer vapor, preferably comprised of saturated steam, in countercurrent fashion. It is also important that the heat transfer medium be employed in an amount of at least 50% by weight of the solvent.

The process of the present invention surprisingly allows effective and efficient total removal of the solvent without damaging the substrate. Moreover, the condensable heat transfer vapor, preferably comprised of saturated steam, as well as being the source of energy for evaporating the solvent, acts as a solvent vapor carrier. Thereby condensation of the vapor in a condenser or some other suitable recovery means allows easy recovery of the solvent so it need not be exhausted to the atmosphere.

DETAILED DESCRIPTION OF THE PREFERRED EMBODIMENTS OF THE INVENTION

Figure 1:
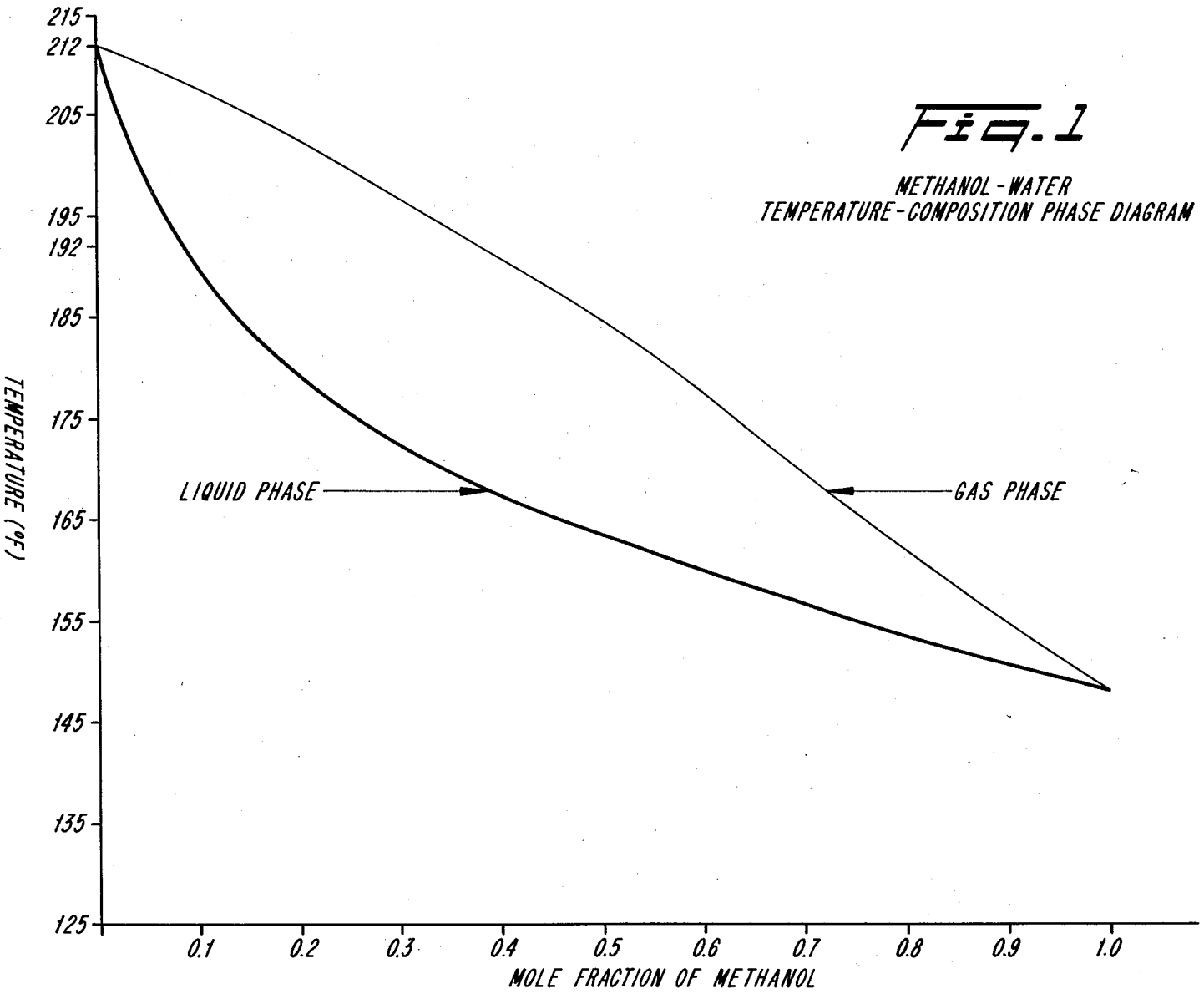
FIG. 1 shows a Methanol-Water Temperature Composition Phase Diagram for use in determining the vapor composition.

More particularly, the condensable, heat transfer vapor employed is a non-oxidizing, condensable vapor having a boiling point higher than the solvent to be removed. Saturated steam is preferred primarily because it is abundantly available and is relatively inexpensive. Other suitable heat transfer vapors which are non-oxidizing agents and condensable, however, can also be used, alone or in conjunction with the steam. Moreover, various agents, if suitable, can be mixed in with the steam for application to the web material. For the sake of convenience, however, the following description of the invention will be rendered in terms of solely saturated steam as the heat transfer vapor, but, the invention is not meant to be limited thereto as noted above.

The saturated steam employed in the process of the instant invention functions not only as a source of energy for evaporating the solvent, but also as the solvent vapor carrier. The saturated steam can be generally described as water vapor containing essentially no superheat so that the transfer of heat is accomplished substantially by condensation. It is preferred that all transfer of heat is from the latent heat of the steam condensing.

The web material containing the solvent, e.g., resin coated paper, is contacted with the saturated steam. The energy for heating the web material, the web's coating, and the solvent, as well as for evaporating the solvent, is derived from the condensation of the steam. The steam which does not condense and the solvent vapors are then sent to recovery, e.g., a multi-plate still or condenser, or some other device or apparatus for separation of the solvent and the water vapor.

In the practice of the present invention, the saturated steam is passed countercurrent to the web material, preferably a paper web, from which the solvent is to be removed. The contacting is achieved in a thermally insulated chamber, which can be vertical or horizontal. It is generally preferred, however, that the chamber be vertical in order to reduce space requirements and to facilitate threading of the web material through the chamber. In such an instance, the web material impregnated with solvent, e.g., methanol, is introduced at the top end and the saturated steam is supplied at the bottom end, e.g., by means of two or more nozzles. The web material and saturated steam thereby move in opposing directions. This is important for total removal of the solvent. For by countercurrent operation, the web material is contacted only with pure steam prior to exiting the contacting chamber. This insures the absence, i.e., total removal, of solvent from the web material.

The walls of the oven are generally, and preferably, very close to the surface of the web in order to maintain turbulent flow within the chamber, which enhances the contact between the steam and the web material. Such enhanced contact improves removal efficiency. The chamber is also preferably sealed at each end, and particularly the top end when vertical, by means of, e.g., inflatable Teflon pillows to prevent any leakage of solvent.

Since the steam moves countercurrent to the direction of the web material, it is enriched with the solvent and the solvent is continuously stripped from the web or sheet material. This process of stripping and enriching takes place until equilibrium is achieved at the exhaust or vapor exit end of the chamber. By monitoring the temperature of the vapor stream at the steam exit end of the chamber, i.e., top end when vertical, by the use of a thermometer or some other temperature sensing means, and using a phase diagram such as that depicted in FIG. 1 of the Drawing for methanol, the composition of the vapor can be determined. The composition of the vapor exiting the chamber can be controlled accordingly by regulating the quantity of steam supplied.

The walls of the chamber are preferably heated by means of steam coils to prevent any condensation of solvent and steam mixture on the walls.

The amount of saturated steam employed is an important parameter of the present invention in order to insure complete removal of the solvent from the web material. The saturated steam must be used in an amount of at least 50% by weight of the solvent to be removed, and preferably at least 65% by weight (as is later shown in a mass and energy balance). Without the use of such a mass of saturated steam, complete removal of the solvent cannot be realized.

Once the contacting is complete and the solvent/excess steam mixture exits the chamber, the mixture can be exhausted to a condenser. In the condenser, the solvent can be recovered as a condensate, particularly when it is methanol. The web material, which exits the chamber wet due to the condensation of water thereon during the steam treatment, can then be passed to a conventional air oven to remove the condensed steam. This is a much more efficient use of the hot air oven since the disadvantages of the air oven are generally connected with the removal of a combustible solvent. In the present instance, however, only water is being removed. Moreover, typically from 40 to 90% of the fuel used in a conventional hot air/solvent oven is utilized to heat simply dilution air, i.e., air provided to keep the solvent concentration below the acceptable safety level, i.e., the LEL. By employing the present invention wherein the solvent is first removed in the steam chamber, large amounts of dilution air are no longer needed in the hot air oven. This allows recirculation of the heated air, and thus the oven is much more energy efficient.

The present invention also offers the advantage of readily converting existing hot air oven equipment. All that is needed is the placement of a contacting chamber in accordance with the present invention in front of any existing hot air oven structure in order to realize and enjoy the benefits of the present invention. Thus, the capital expenditure of employing the present invention can be great.

Other advantages of the present invention include the potential removal and recovery of all solvent from the web material. This can be achieved upon properly sizing the chamber and condenser and/or selecting a suitable throughput speed. Furthermore, the vapor mixture exhausted to recovery is generally fairly concentrated in solvent vapor thereby facilitating recovery of the solvent. Moreover, since a superheater is not needed in the present invention due to the use of saturated (vis-a-vis superheated) steam, the total capital cost for the entire system is much lower than that of any other solvent recovery system heretofore known.

In an illustration of the theoretical energy balance and potential steam requirements for practicing the present invention, the following calculation is offered for the removal of methanol solvent from a resin impregnated paper web. The calculation is based upon 1 ton of finished product. The assumptions and physical constants used in the calculation are first expressed.

Assumptions:

One ton of product contains 18% resin and 6% moisture.

Steam enters the oven at 212° F. and the steam-methanol mixture leaves the oven at 149° F.

The paper enters the oven at 70° F. and leaves at 212° F.

Physical Constants:

| | |
|---|---|
| Boiling Point of methanol (at 1 atm.) = | 149° F. |
| Heat Capacity of liquid methanol (70° F.–212° F.) = | 0.6 Btu/lb °F. |
| Average heat capacity of paper w/resin (70° F.–212° F.) = | 0.34 Btu/lb °F. |
| Latent heat of methanol (at 1 atm.) = | 471.6 Btu/lb |
| Latent heat of water (at 1 atm.) = | 970.0 Btu/lb |

Methanol Evaporation Rate Calculation:

| | |
|---|---|
| One ton of finished product contains | 1520 lbs paper (76%)<br>360 lbs resin (18%)<br>120 lbs moisture (6%)<br>2000 lbs |
| Amount of 28% resin solution required to get 360 lbs of resin in 1 ton finished product = | 360<br>0.28 =<br>1286 lbs |
| Amount of methanol in 1286 lbs of resin solution = | 1286 − 360 =<br>926 lbs |
| Therefore, methanol evaporation rate per ton of paper = | 926 lbs =<br>140 gallons |

Energy Requirement for the Oven:

| | |
|---|---|
| Quantity of heat required to heat paper and resin from 70° F. to 212° F. = mass × heat capacity of paper and resins × T<br>1880 × 0.34 × (212 − 70) | 90,766 Btu |
| Quantity of heat required to heat methanol from 70° F. to 149° F. = mass × heat capacity of MeOH × T<br>26 × 0.6 × (149 − 70) | 43,892 Btu |
| Quantity of heat required to evaporate methanol at 149° F. = mass × latent heat of MeOH<br>926 × 471.6 | 436.702 Btu |
| Quantity of heat required to heat moisture from 70° F.–212° F. = mass × heat capacity of water × T<br>120 × 1.0 × (212 − 70) | 17,040 Btu |
| Total energy requirement for the oven A + B + C + D = | 588,400 Btu/ton of paper |

Steam Requirement for the Oven:

Saturated steam at 212° F. is available and latent heat of steam is used to provide the energy for the oven.

Amount of saturated steam required =

-continued $$\frac{\text{total energy requirement}}{\text{latent heat of steam}}$$

$$= \frac{588{,}400}{970}$$

$$= 607 \text{ lbs/ton}$$

Theoretical Ratio of Saturated Steam to Solvent:

$$\frac{607}{926} = .65 \text{ or } 65\%$$

The process of the instant invention can be employed for the removal of any non-aqueous solvent. Recovery of the non-aqueous solvent from the saturated steam is complete and easy upon condensation thereof. This is true whether the non-aqueous, e.g., organic solvent, is miscible or immiscible with water. If the solvent is water-miscible, then distillation is employed to separate the solvent from the condensed steam in order to recover the pure solvent. If the solvent, however, is not miscible with water, then simple decantation can be employed to separate the solvent from the condensed steam. The solvent need not be miscible with water for the process to be effective.

The process of the present invention also pertains to any web material from which a non-aqueous liquid is to be removed. Generally, said non-aqueous liquid is a solvent employed to impregnate said web substrate with a resin or the like. In this context, the present invention has particular applicability to a paper substrate which has been impregnated with a resin wherein the resin was applied in an organic solvent. Examples of resins include phenol-formaldehyde, a polyvinyl acetate, nylon, cellulose acetate and others which have low water tolerance. More particularly, the instant invention has applicability to the removal of an alcohol solvent, i.e., methanol, employed in impregnating a paper substrate with a phenolic resin, such as that available from Georgia Pacific, Inc., e.g., their resin identified by the trademark TYBON TM 975, or a polyvinyl acetate. Such resins are generally employed in the impregnation of a high bulk, low density paper substrate which can be employed ultimately as filter paper. The paper substrate generally has a high void volume of from about 60–90% by volume. The paper web substrate is contacted with the resin dissolved in the alcohol solvent to thereby impregnate the paper web. Then, in accordance with the instant invention, the alcohol solvent can be safely and efficiently removed by contacting the web with an effective amount of saturated steam for a period of time sufficient to effect removal of the alcohol from the web.

The present invention, however, also finds application for the removal of non-aqueous liquids from cloth, non-woven and woven fabrics or polymer webs.

One of the advantages of the process is that it can be and is preferably run at low pressures, e.g., from −5 to +5 psig, although higher pressures can be employed if so desired. It is preferred to run the process at these low pressures in order to simplify the apparatus employed. If high pressures were used, a pressure vessel would have to be employed and there would be problems with the end seals and leakage of steam. These problems can be avoided by employing low pressures. Essentially atmospheric pressure is preferred.

As indicated, a vacuum can even be employed in the oven or steam chamber. It is preferred, however, to keep a slight positive pressure, i.e., from 0 to about 5 lbs per square inch of pressure, to thereby prevent air from entering the chamber and complicating matters with explosion problems. However, if the solvent to be removed is not inflammable, there is no objection to running the process under a slight negative pressure.

Figure 2:
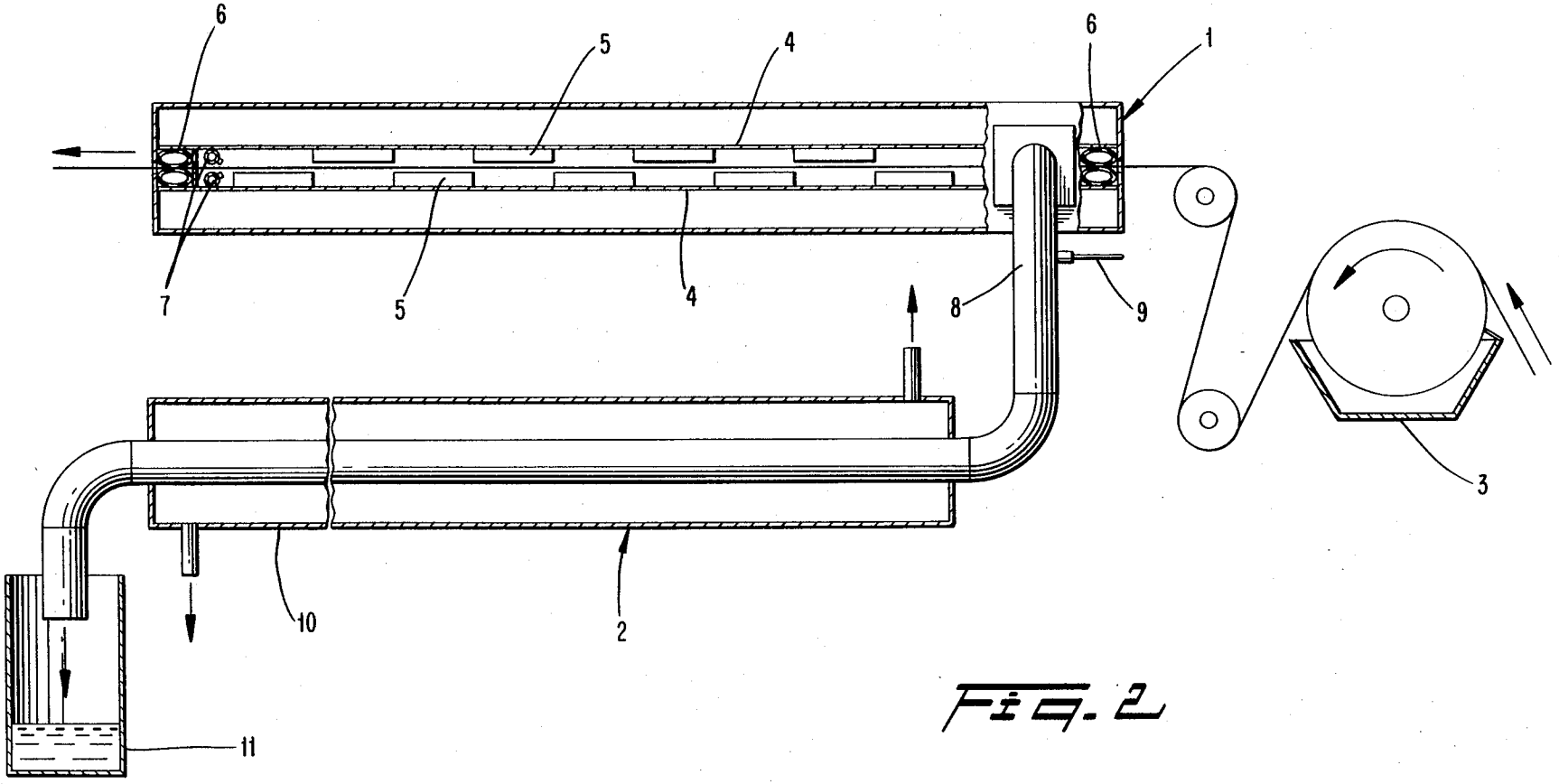
FIG. 2 shows a first embodiment of the invention.
Figure 3:
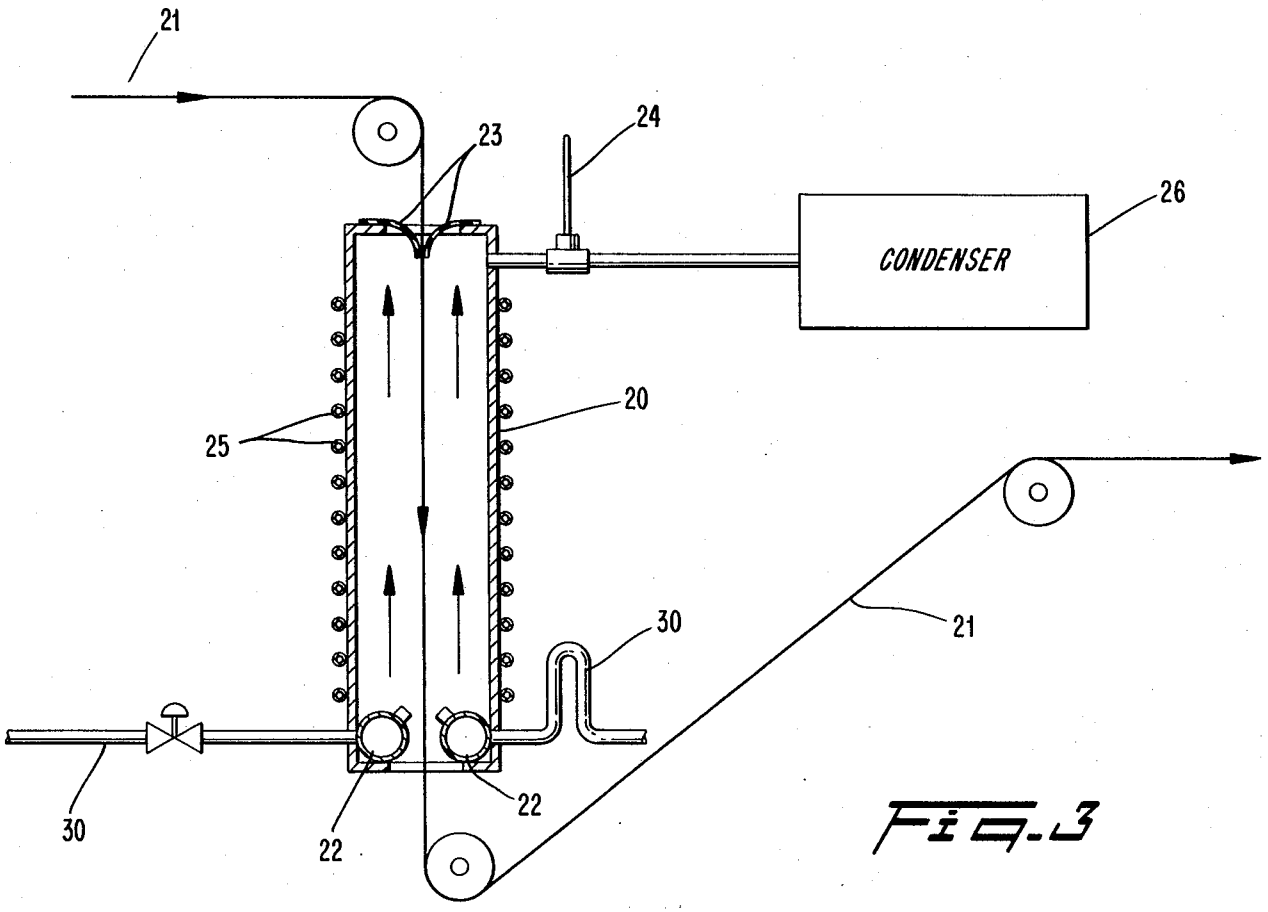
FIG. 3 shows a second preferred embodiment of the invention.

Reference to FIGS. 2 and 3 of the Drawing will aid in describing specific embodiments of the instant invention and suitable apparatus employed therefor.

Referring to FIG. 2, the solvent recovery unit shown consists of a four feet long×fourteen inch wide chamber 1, twenty feet long double pipe condenser 2 and an applicator roll 3 with doctor blade. The gap between the chamber walls 4 is generally preferred to be about one-half inch, and about one-quarter inch between the paper surface and the wall. This maintains good turbulence in the chamber. Baffles 5 can also be used to create such desired turbulence.

The chamber walls are built out of an insulating material called "Marinite" Marinite has not only good insulating properties but also good structural strength. Teflon covered rubber tubes make up the chamber seals 6. The rubber tubes can be inflated or deflated by turning an air supply on or off to the tubes. The tubes are generally deflated when threading the chamber and inflated during the normal course of operation. The inflated rubber tubes provide tight seals between the web and the smooth Teflon surface to prevent any vapor leakage. Although the web is held tight between the inflated tubes, it slides on the smooth Teflon surface without any adverse effect on the paper surface. To provide the right amount of tightness, the pressure inside the tubes (approx. 1 psi) can be adjusted by means of pressure regulators provided on the air supply lines.

Two steam manifolds 7 are provided inside the chamber, e.g., one inch black iron pipes with 108 closely spaced one-sixteenth inch diameter holes. The manifolds can be rotated around their axis to change the angle of impingement of the steam jet.

The steam after impinging into the web, flows counter current to the direction of paper and is exhausted at the solvent rich end 8. The baffles 5 provided along the path of steam, increase turbulence and enhance steam-solvent mixing to improve solvent removal efficiency. Tne temperature of steam-solvent mixture is measured by means of a thermometer 9 provided in the exhaust line. The temperature of the exhaust mixture can be used to determine the composition of the vapor.

The exhaust vapor is condensed in the inner pipe of the double pipe condensor by circulating cooling water through the outer pipe (approx. 17 gpm) 10. The condensor is preferably slightly slanted for faster removal of the condensate and to improve heat transfer. The condensate is collected in a suitable receptacle 11.

The solvent (methanol) saturation unit 3 basically consists of an applicator roll with doctor blade and a pan. Base paper gets saturated when it wipes the surface of the applicator roll dry of resin solution. The applicator roll surface speed is kept approximately same as the web speed. The doctor blade can be adjusted to give the desired pick up.

A preferred structure of the chamber is vertical as shown in FIG. 3. The dimensions are the same as in the FIG. 2 apparatus described above.

Briefly, referring to FIG. 3, the contacting chamber 20 consists of a thermally insulated vertical chamber. Sheet material 21 impregnated with a non-aqueous liquid, e.g., organic solvent, is introduced at the top end of the chamber and the heat transfer vapor, e.g., saturated steam, is supplied at the bottom end by means of two nozzles 22, provided by conduits 30. The sheet and steam move in opposing directions.

The chamber is sealed at the top end by means of expandable pillows 23, e.g., Teflon pillows, to prevent any leakage of solvent. A thermometer 24 placed in the vapor stream at the top end of the oven monitors the temperature. The chamber walls are preferably heated by means of steam coils 25 to prevent any condensation of solvent and steam mixture on the walls.

The vapor coming out at the top end of the chamber is condensed in a condenser 26 and collected. The sheet material 21 exits at the lower end of the chamber and is passed on, e.g., to an air oven to remove condensed steam.

In order to further illustrate the present invention and the advantages thereof, the following specific examples are given, it being understood that same are intended only as illustrative and in nowise limitative. All parts and percentages in the examples and the remainder of the specification are by weight unless otherwise specified.

EXAMPLE

This example illustrates the practice of the present invention in removing and recovering methanol solvent from a phenolic saturated paper sheet without adversely affecting the physical properties of the paper sheet.

The solvent recovery unit used for the experiment is that shown in FIG. 2. Trials 1 and 2 were conducted using a 10 inch wide roll of 76.9 lb base paper and trial 3 was run using a 12 inch wide roll of 66.9 lb paper. All the trials were run at 200 feet per minute (fpm) and the resin pick up level was maintained between 16–19%. Saturated steam was used as the heat transfer vapor. Temperature and flow rate of the steam entering the contacting chamber were measured continuously. The steam-methanol mixture exhausted from the contacting chamber was condensed and collected for a specific period of time to determine the flow rate. Exhaust temperature of the steam-methanol mixture was recorded and the condensate sample was analyzed for methanol content. Samples of the steam treated paper were subsequently dried in a conventional hot air oven and tested for physical strength. Physical strength properties were then compared to those of a saturated sheet dried conventionally in a hot air oven. Each trial was repeated at three different flow rates (118, 108, and 162 lbs/hr). The results are tabulated in Tables I, II and III below:

TABLE I

Web Speed: 200 fpm
Resin Composition: 28% Solids (Phenolformaldehyde resin, Polyvinyl acetate) 72% Methanol

| Trial No. | Web Width (in.) | Steam Flow Rate (lb/hr.) | Basis wt. O.D. (lb/rm.) Base Paper | Basis wt. O.D. (lb/rm.) Saturated Paper | Resin Pickup lb/rm | Resin Pickup % | MeOH Pickup lb/rm | MeOH Pickup % | MeOH Steam Exhaust Temp. °F. |
|---|---|---|---|---|---|---|---|---|---|
| 1 | 10 | 119 | 76.9 | 94.2 | 17.3 | 18.4 | 44.5 | 32.0 | 190 |
| 2 | 10 | 108 | 76.9 | 92.5 | 15.6 | 16.9 | 40.1 | 30.2 | 192 |
| 3 | 12 | 162 | 66.9 | 81.1 | 14.2 | 17.6 | 36.5 | 31.0 | 188 |

| Trial No. | Condensate Flow Rate (lb/hr.) | *Condensate Composition w/w % | Methanol Addition Rate (lb/hr.) | Methanol Recovery Rate (lb/hr.) | Recovery Efficiency % | Ratio: Steam/Solvent |
|---|---|---|---|---|---|---|
| 1 | 113.6 | 55.3 | 148.3 | 62.5 | 42 | 0.80 |
| 2 | 104.1 | 51.6 | 133.6 | 53.7 | 40 | 0.80 |
| 3 | 172.3 | 56.0 | 146.0 | 96.5 | 66 | 1.11 |

*As determined by gas chromatography.

TABLE II

Base Paper Basis Wt.: 66.9 lb O.D.
Trial No.: 3

| | Basis Wt. (lb/rm) | Resin Pickup % | Caliper (inches) | Frazier (CFM) | Mullen | Tensile (lb/inch) |
|---|---|---|---|---|---|---|
| Control | 82.9 | 19.3 | 0.020 | 28.8 | 24.8 | 32.8 |
| *Steam-treated | 81.1 | 17.6 | 0.019 | 24.4 | 28.9 | 33.7 |

*The slight decrease in caliper is due to squeezing of the wet sheet coming out of the steam oven.

TABLE III

| Trial | Methanol Composition w/w % GC Value | Methanol Composition w/w % Phase Diagram Value |
|---|---|---|
| 1 | 55.3 | 55.8 |
| 2 | 51.6 | 52.1 |
| 3 | 56.0 | 59.2 |

The foregoing results clearly demonstrate the ability of the present process to remove solvent and further allow recovery thereof. Total removal and recovery of the solvent can easily be achieved through the practice of the present invention by appropriate sizing of the chamber, e.g., a 6 foot long chamber, and selection of throughput speed, e.g., 100 fpm.

Table III demonstrates that the methanol composition of the vapor exit stream can be determined by use of a temperature monitor at the exhaust point in conjunction with the phase diagram of FIG. 1.

It is also important to note that there is no significant difference between the physical strength properties of the steam treated paper vis-a-vis the saturated paper with no steam treatment. The slight reduction in caliper and CFM is due to pressing of the moist sheet by the drive rolls. Accordingly, despite the belief that use of saturated steam would have a detrimental effect on the paper web, the subject invention allows for total solvent removal and solvent recovery at low capital cost and energy efficiency, all without adversely effecting the physical properties of the paper sheet.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. A process for the removal of a non-aqueous liquid from a web material impregnated or coated with same, comprising contacting the web material with an effective amount of a condensable, heat transfer vapor which condenses at least in part upon the web in an amount sufficient to provide substantially all of the energy for removal of the non-aqueous liquid, with the contact being conducted countercurrent fashion, and with the amount of heat transfer vapor employed being at least 50% by weight of the non-aqueous liquid.

2. The process of claim 1, wherein the heat transfer vapor comprises saturated steam.

3. The process of claim 2, wherein the excess saturated steam in mixture with removed non-aqueous solvent vapor is passed to a recovery apparatus to recover the liquid.

4. The process of claim 3, wherein the chamber configuration is such as to induce turbulent vapor flow.

5. The process of claim 3, wherein the process is conducted in a thermally insulated chamber and the temperature of the excess saturated steam in mixture with removed non-aqueous solvent vapor is monitored as the mixture exits the chamber.

6. The process of claim 5, wherein the quantity of steam supplied to the chamber is regulated in response to the temperature monitor.

7. The process of claim 2, wherein the web material is a cellulosic substrate.

8. The process of claim 7, wherein the web material is a paper web coated with a solvent soluble resin with low water tolerance and the non-aqueous liquid removed from said paper is the organic solvent employed in impregnating the paper with the resin.

9. The process of claim 8, wherein the organic solvent is methanol.

10. The process of claim 8, wherein the resin is a phenolic resin or polyvinyl acetate resin.

11. The process of claim 2, further comprising passing the substrate contacted with the heat transfer vapor, after the contacting is complete, to a hot air oven in order to evaporate condensed steam.

12. The process of claim 11, wherein the web material is a cellulosic substrate.

13. The process of claim 12, wherein the web material is a paper coated with phenolic resin or polyvinyl acetate resin and the non-aqueous liquid removed from the paper is the organic solvent employed in impregnating the paper with the resin.

14. The process of claim 13, wherein the organic solvent is methanol.

15. The process of claim 1, wherein the heat transfer vapor consists essentially of saturated steam.

16. The process of claim 1, wherein the amount of heat transfer vapor employed is at least 65% by weight of the non-aqueous liquid.

17. The process of claim 1, wherein the contacting is conducted in a thermally insulated chamber.

18. A process for impregnating a paper with a resin which comprises:

(1) contacting the paper with a solution comprising said resin dissolved in an organic solvent, and (2) removing the organic solvent from the paper by contacting the paper with a heat transfer vapor comprising saturated steam in countercurrent fashion, with the amount of saturated steam employed being at least 50% by weight of the organic solvent in the paper, and with the steam condensing at least in part upon the paper in an amount sufficient to provide substantially all of the energy for removal of the organic solvent.

19. The process of claim 18, wherein the resin is a phenolic resin or polyvinyl acetate resin and the organic solvent is an slcohol.

20. The process of claim 19, wherein the organic solvent is methanol.

21. The process of claim 18, wherein excess saturated steam in mixture with organic solvent removed from the paper is passed to a separation unit in order to recover the solvent.

22. The process of claim 21, wherein the process is conducted in a thermally insulated chamber and the temperature of the excess saturated steam in mixture with organic solvent is monitored as the mixture exits the chamber.

23. The process of claim 22, wherein the quantity of steam supplied to the chamber is regulated in response to the temperature monitor.

24. The process of claim 18, further comprising passing the paper upon completion of the contacting with the saturated steam heat transfer vapor through a hot air oven in order to evaporate condensed steam.

25. A process for the removal of a non-aqueous liquid from a web material impregnated or coated with same, comprising contacting the web material with an effective amount of a condensable, heat transfer vapor comprising saturated steam which condenses at least in part upon the web to provide energy for removal of the non-aqueous liquid, with the contact being conducted in counter-current fashion, and with the amount of saturated steam employed being at least 50% by weight of the non-aqueous liquid, conducting the process in a thermally insulated chamber, and passing excess saturated steam in mixture with removed non-aqueous solvent vapor to a recovery apparatus to recover the liquid, with the temperature of the excess saturated steam in mixture with removed non-aqueous solvent vapor being monitored as the mixture exits the chamber.

26. The process of claim 25, wherein the quantity of steam supplied to the chamber is regulated in response to the temperature monitor.

27. A process for impregnating a paper with a resin which comprises:

(1) contacting the paper with a solution comprising said resin dissolved in an organic solvent, (2) removing the organic solvent from the paper by contacting the paper with a heat transfer vapor comprising saturated steam in counter current fashion, the amount of saturated steam employed being at least 50% by weight of the organic solvent in the paper, and with the steam condensing at least in part upon the paper to provide energy for removal of the organic solvent, (3) conducting the process in a thermally insulated chamber, and (4) passing excess saturated steam in mixture with organic solvent removed from the paper to a separation unit in order to recover the solvent, with the temperature of the excess saturated steam in mixture with organic solvent being monitored as the mixture exits the chamber.

28. The process of claim 27, wherein the quantity of steam supplied to the chamber is regulated in response to the temperature monitor.

* * * * *